US006575660B1

(12) United States Patent
Davis et al.

(10) Patent No.: US 6,575,660 B1
(45) Date of Patent: Jun. 10, 2003

(54) TEMPORARY ROAD BED

(76) Inventors: Darrell Davis, P.O. Box 33, Citronelle, AL (US) 36522; Ronald U. Davis, P.O. Box 278, Citronelle, AL (US) 36522

( * ) Notice: Subject to any disclaimer, the term of this patent is extended or adjusted under 35 U.S.C. 154(b) by 0 days.

(21) Appl. No.: 09/625,495

(22) Filed: Jul. 25, 2000

(51) Int. Cl.[7] ..... E01C 9/08
(52) U.S. Cl. ..... 404/35; 404/36; 238/14
(58) Field of Search ..... 52/581, 582.1, 52/586.1, 592.1, 585.1, 745.02, 745.03, 745.19, 745.2, 747.1, 561, 562, 563, 564; 404/35, 36, 40, 46; 238/14

(56) References Cited

U.S. PATENT DOCUMENTS

| | | | | | |
|---|---|---|---|---|---|
| 488,371 | A | * | 12/1892 | Smith | |
| 1,549,775 | A | * | 8/1925 | Keyser, Jr. | 404/35 |
| 1,935,823 | A | * | 11/1933 | Turner | 404/35 |
| 2,335,556 | A | * | 11/1943 | Wilson | |
| 2,367,917 | A | * | 1/1945 | Arthur | |
| 2,402,090 | A | * | 6/1946 | Ruppel | |
| 3,315,578 | A | * | 4/1967 | Wesch et al. | |
| 3,913,291 | A | * | 10/1975 | Dulien et al. | 52/403 |
| 3,961,751 | A | * | 6/1976 | Kessler | 238/10 R |
| 4,289,420 | A | | 9/1981 | Davis et al. | 404/35 |
| 4,376,596 | A | * | 3/1983 | Green | 404/35 |
| 4,453,283 | A | * | 6/1984 | Fitzgerald-Smith et al. | 14/73 |
| 4,462,712 | A | | 7/1984 | Penland, Sr. | 404/36 |
| 4,538,392 | A | | 9/1985 | Hamar et al. | 52/582 |
| 4,600,336 | A | | 7/1986 | Waller, Jr. | 404/35 |
| 4,600,337 | A | * | 7/1986 | Sarver | 404/35 |
| 4,629,358 | A | * | 12/1986 | Springston et al. | 404/35 |
| 4,653,168 | A | | 3/1987 | Herbert | 29/426.5 |
| 4,681,482 | A | * | 7/1987 | Arciszewski et al. | 404/35 |
| 4,875,800 | A | | 10/1989 | Hicks | 404/35 |
| 4,889,444 | A | | 12/1989 | Pouyer | 404/34 |
| 4,964,751 | A | * | 10/1990 | Rope et al. | 404/35 |
| 4,973,193 | A | | 11/1990 | Watson et al. | 404/35 |
| 5,020,937 | A | | 6/1991 | Pouyer | 404/35 |
| 5,032,037 | A | | 7/1991 | Phillips et al. | 404/73 |
| 5,087,149 | A | | 2/1992 | Waller, Jr. | 404/35 |
| 5,118,542 | A | * | 6/1992 | McLeod | 428/33 |
| 5,163,776 | A | | 11/1992 | Pouyer | 404/35 |
| 5,201,601 | A | | 4/1993 | Stanley et al. | 404/35 |
| 5,282,692 | A | * | 2/1994 | McLeod | 404/35 |
| 5,313,756 | A | | 5/1994 | Ways et al. | 52/263 |
| 5,316,408 | A | | 5/1994 | Stanley et al. | 404/35 |
| 5,457,837 | A | * | 10/1995 | Zuckerbrod | 404/40 |
| 5,651,154 | A | | 7/1997 | Ahlskog et al. | 14/6 |
| 5,822,944 | A | | 10/1998 | Penland, Sr. | 52/591.1 |
| 5,913,781 | A | * | 6/1999 | Vidmar et al. | 16/223 |

* cited by examiner

*Primary Examiner*—Robert E. Pezzuto
*Assistant Examiner*—Raymond W Addie
(74) *Attorney, Agent, or Firm*—Roylance, Abrams, Berdo & Goodman, L.L.P.

(57) ABSTRACT

A method and apparatus for constructing a temporary road bed include a mat formed from a plurality of planks having a longitudinal dimension and spaced-apart a uniform distance by a spacer. A flexible cable extends through apertures in the planks and spacers for coupling the planks and spacers together. The flexible cable allows the mat to bend and conform to the ground surface and can be rolled and folded upon itself. In one embodiment, the planks include at least one recess in a top face for interlocking with a plank of a second mat. The mats can be coupled together in an end-to-end relation to obtain a desired length or width or in a stacked relation to obtain a desired thickness of the road bed.

29 Claims, 8 Drawing Sheets

FIG. 3
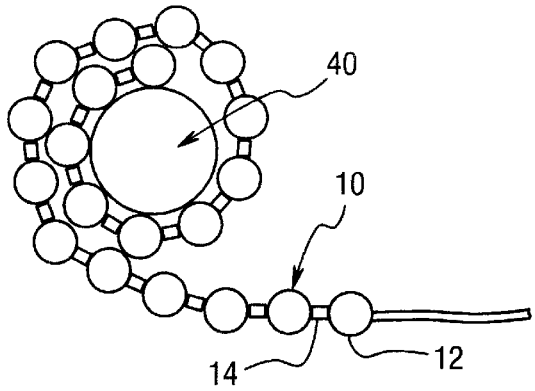
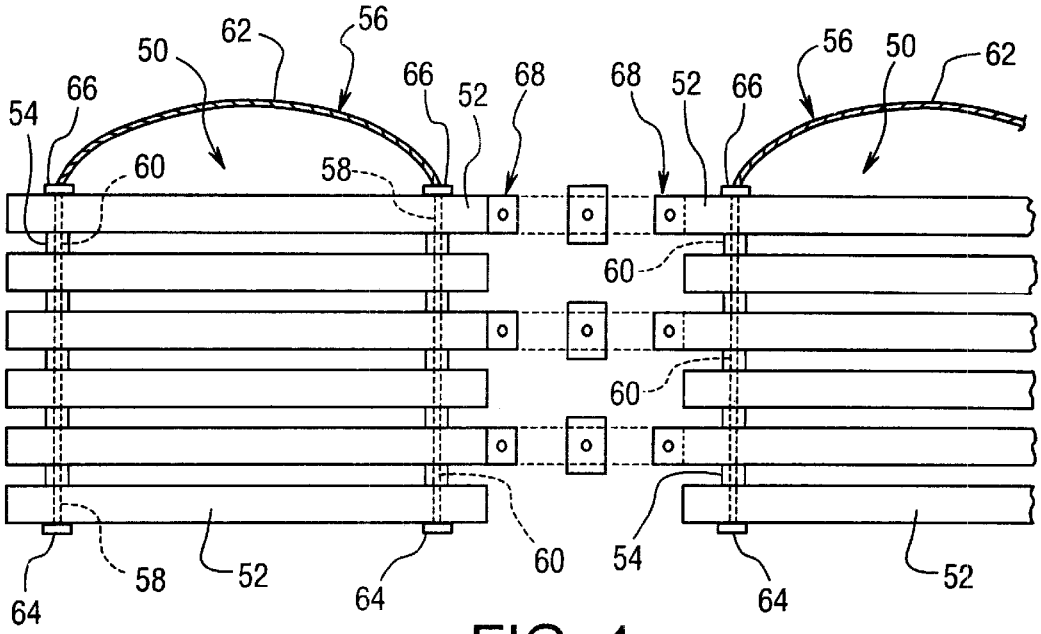
FIG. 4
FIG. 5
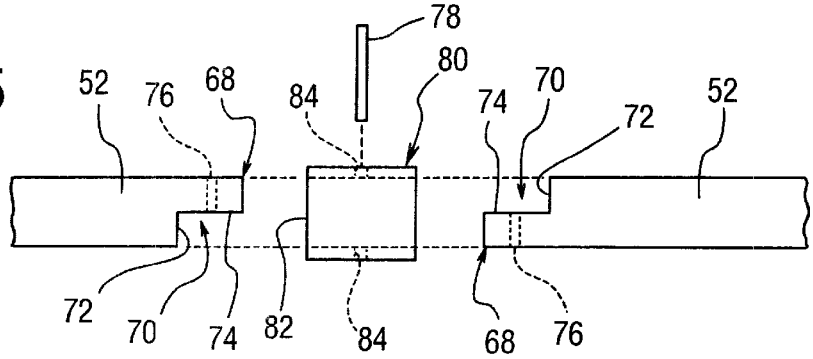

TEMPORARY ROAD BED

FIELD OF THE INVENTION

The present invention is directed to a temporary road bed for placing on the ground. More particularly, the invention is directed to a flexible mat structure for use in constructing a temporary road bed.

BACKGROUND OF THE INVENTION

Work sites, such as construction sites and oil drilling sites, often occur in areas where there is no prepared road bed. Heavy equipment used at the work site require a suitable road bed that is stable to prevent the equipment from becoming stuck in the soft ground.

A common practice for many years has been to construct a temporary road bed from wood planks that are laid on the ground and nailed together. Typically, a second and third layer of wood planks are laid on top of the base layer in alternating directions and secured together by nails. The number of layers of wood planks can vary depending on the stability of the ground and the weight of the equipment that will travel over the road.

Construction of a temporary road bed using individual boards is costly and labor intensive. The heavy equipment that travels over the road bed often damages a large number of the boards so that the boards cannot be reused. Disassembly of the road bed is also labor intensive and damages many of the boards not previously damaged during use. As a result, a significant portion of the boards used to construct the road bed are discarded.

Various methods have been proposed to form a temporary road bed using preassembled mats constructed from wood boards. These mats typically include a structure for interlocking with an adjacent mat. These preconstructed mats are generally intended to be reusable by disassembling the road bed and transporting the mats to a new location.

Numerous examples of preconstructed mats for use in constructing a temporary road bed or flooring system are known. One example is disclosed in U.S. Pat. No. 5,822,944 to Penland. The mat disclosed therein includes interlocking ends and sides for connecting a plurality of mats together. Each mat is formed from two layers of boards that are attached together. The first layer includes a plurality of boards having different lengths to form interlocking tabs at one end. The second layer is formed from boards extending perpendicular to the boards of the first layer and staggers the boards to form locking tabs at one end and locking slots at the opposite end.

Examples of other mats for use in constructing a temporary road bed are disclosed in U.S. Pat. No. 4,289,420 to Davis et al., U.S. Pat. No. 4,600,337 to Sarver, and U.S. Pat. No. 4,889,444 to Pouyer. These devices are similar in that they are constructed of boards assembled in various layers and formed with an interlocking connection for connecting with a similar mat.

The prior methods of constructing a temporary road bed are generally expensive and time consuming. Although the preconstructed mats can reduce the time for constructing a temporary road, the cost of manufacturing the mats and the difficulty of moving and assembling the mats have limited their use.

In view of the deficiencies of the prior methods and devices, a continuing need exists in the industry for an improved method and device for constructing a temporary road bed.

SUMMARY OF THE INVENTION

The present invention is directed to a method and apparatus for constructing a temporary road bed. More particularly, the invention is directed to a mat structure for constructing a temporary road bed.

Accordingly, a primary object of the invention is to provide a economical method and device for constructing a road bed.

Another object of the invention is to provide a device for constructing a road bed that is comparatively lightweight and durable.

A further object of the invention is to provide a device for constructing a road bed that is sufficiently flexible to conform to the contour of the ground.

Still another object of the invention is to provide a device for constructing a road bed that can be used individually or in combination with a similar mat.

Another object of the invention is to provide a mat for constructing a road bed that can interlock with an adjacent mat of similar structure.

A further object of the invention is to provide a mat for a road bed that is sufficiently flexible to be folded over upon itself to form a two-layered support.

A further object of the invention is to provide a mat for constructing a road bed that is sufficiently flexible to be rolled on a spool during storage and transported where the mat can be unrolled at a work site.

A further object of the invention is provide a mat for constructing a road bed formed from a plurality of planks coupled together by a flexible connecting member.

Another object of the invention is to provide a mat for constructing a road bed where the mat is formed from a plurality of planks where the planks can interlock with an adjacent mat.

Another object of the invention is to provide a mat for constructing a road bed where the mat is formed from a plurality of planks where the mats can be stacked in at least two layers with the planks interlocking with a superimposed mat.

The objects of the invention are basically attained by providing a mat for forming a temporary road bed. The mat comprises a plurality of support members arranged in a parallel, side-by-side relationship. Each of the support members has a length and a width wherein the length is greater than the width. The support members further have at least two holes extending transversely through the support members. A plurality of spacers are positioned between each of the adjacent support members for spacing the support members apart a substantially uniform distance. Each spacer has a length less than a length of the support members, a width, and a hole extending transversely therethrough. A flexible connecting member extends through the holes in the support members and the spacers for coupling the support members and spacers together.

The objects of the invention are further attained by providing a temporary road bed comprising a plurality of mats. Each of the mats comprises a plurality of planks arranged in a spaced-apart parallel relationship. The planks have at least two spaced apart holes extending transversely through the planks. A plurality of spacers is between the planks for spacing the planks apart a substantially uniform distance. The spacer has a hole extending transversely therethrough. A flexible connecting member extends through the holes in the planks and the spacers for connecting the planks and spacers together. The connecting member is sufficiently flexible whereby the mat can be rolled onto a spool and can conform to the contour of the ground.

The objects of the invention are also attained by providing a method of producing a road bed comprising the step of providing a plurality of flexible mats, each mat constructed of a plurality of support members arranged in a parallel, side-by-side relationship. Each of the support members has a length and a width wherein the length is greater than the width. The support members further have at least two holes extending transversely through the support members. A plurality of spacers is positioned between each of the adjacent support members for spacing the support members apart a substantially uniform distance. Each of the spacers have a length less than a length of the support members, and a hole extending transversely therethrough. A flexible connecting member extends through the holes in the support members and the spacers for coupling the support members and spacers together. The mats are placed on the ground to be contiguous with an adjacent mat to form the road bed.

The objects, advantages and salient features of the invention will become apparent to one skilled in the art in view of the annexed drawings and the detailed description of the invention which form a part of this original disclosure.

SUMMARY OF THE INVENTION

Referring to the drawings which form a part of this disclosure in which:

FIG. 3 is an end view showing the mat of FIG. 1 rolled on a spool;

FIG. 4 is a top view of a mat in a second embodiment of the invention showing the coupling ends of the planks for coupling the mats together;

FIG. 5 is a partial side view of the coupling ends and connecting member of the mat of the embodiment of FIG. 4;

DETAILED DESCRIPTION OF THE INVENTION

The present invention is directed to a portable and reusable mat structure capable of supporting the weight of a vehicle. More particularly, the invention is directed to a mat that can be used in constructing a temporary road bed particularly in soft soil or sand.

Figure 1:
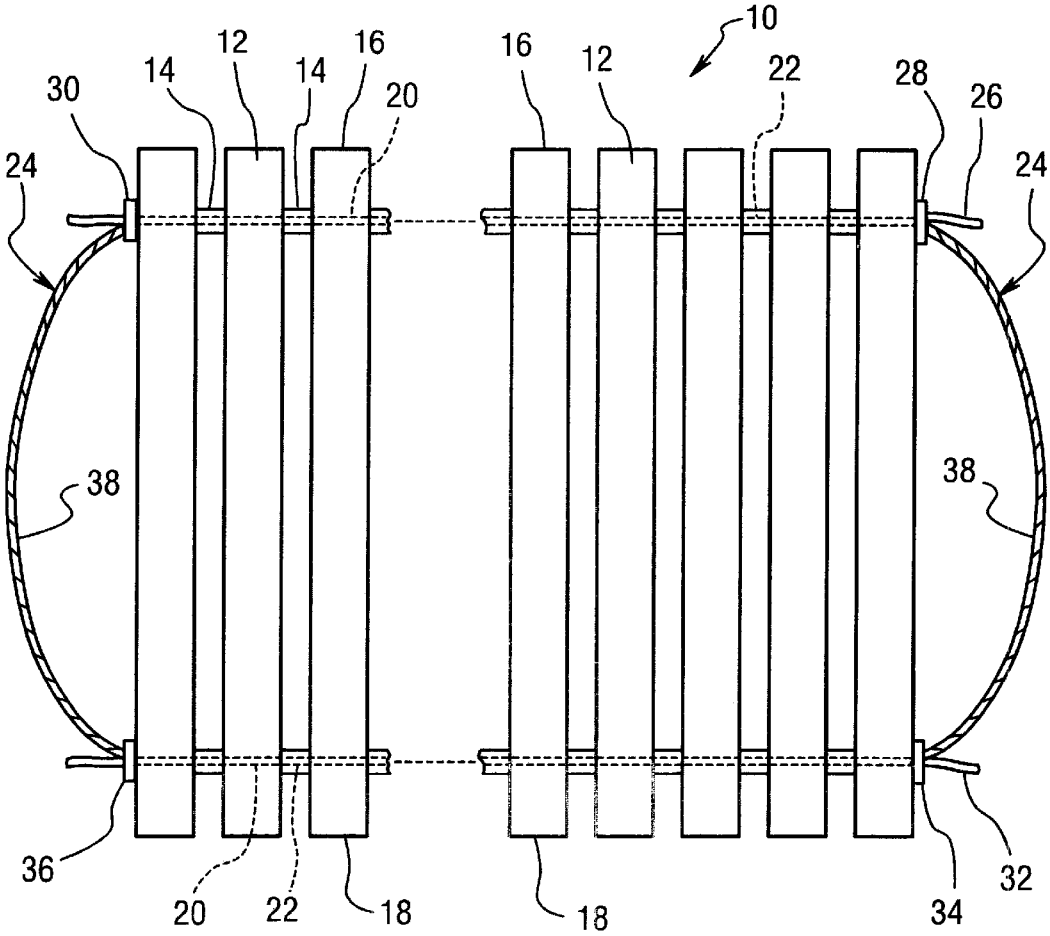
FIG. 1 is a top view of the mat in a first embodiment of the invention showing the spaced-apart planks.
Figure 2:
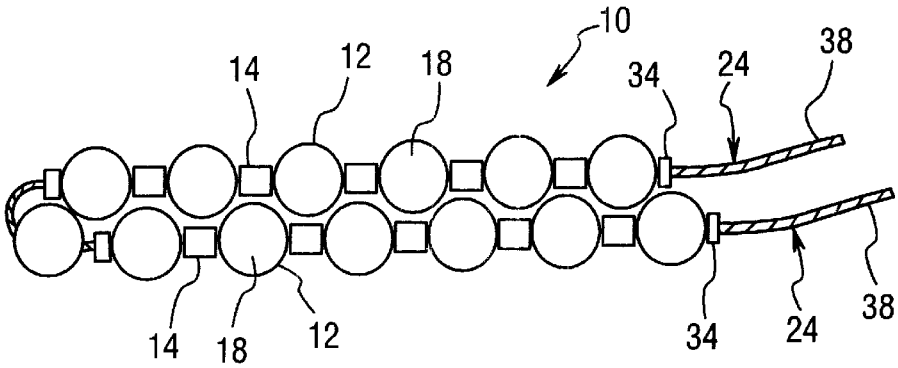
FIG. 2 is an end view of the mat of FIG. 1 shown in a stacked relation with an identical mat.

Referring to FIGS. 1–3, a first embodiment of the invention is directed to a mat 10 formed from a plurality of support members in the form of planks 12 and spacing members 14. Mat 10 as shown in FIG. 1 is formed from a plurality of planks 12 arranged side-by-side and spaced apart by spacers 14. In the embodiment illustrated, planks 14 have a substantially circular cross-section and a substantially cylindrical shape. As used herein, the term "planks" refers to a support member that is capable of forming a road bed supporting the weight of the intended traffic, such as vehicular traffic or pedestrian traffic. The planks can have a cylindrical, square or rectangular shape.

Planks 12 are formed with an axial face 16 at a first end and an axial face 18 at a second end that face in opposite directions and form parallel side edges of mat 10. In one embodiment of the invention, planks 12 are of substantially uniform length and arranged with the respective axial faces aligned in the same plane so that mat 10 has substantially straight sides. In an alternative embodiment, the planks 12 can be offset or staggered with respect to an adjacent plank 12 so that the axial face of each plank is staggered with respect to an adjacent plank 12.

Spacers 14 in the embodiment illustrated have a height and width less than the height and width of planks 12 as shown in FIG. 2. Spacers 14 preferably have a length less than the length of planks 12. As used herein, the length of spacers 14 refer to the dimension of spacers 14 extending transverse to a longitudinal length of planks 12. In one embodiment, spacers 14 have a length less than the width of planks 12 to form a space or gap between adjacent planks that is less than the width of planks 12. Spacers 14 in the embodiment illustrated have a generally square cross-section. In further embodiments, spacers 14 can have a generally cylindrical shape or other shape.

Planks 12 are provided with a hole 20 extending transversely through planks 12 with respect to the longitudinal dimension. Hole 20 is spaced from each axial face 16 and 18. Preferably, at least two holes 20 are provided in each plank 12, although additional holes may be provided and spaced along the length of planks 12 as needed. Each spacer 14 also includes a hole 22 extending through the spacer in the longitudinal dimension of spacer 14. A connecting member 24 extends through hole 20 in plank 12 and hole 22 in spacers 24 for coupling planks 12 and spacers 14 together to form mat 10.

In preferred embodiments, connecting member 24 is a flexible cable that extends at least the length of the mat 10 through each of the holes 20 in planks 12 and holes 22 in spacers 14. Connecting member 24 can be made of any suitable material having sufficient strength to couple planks 12 and spacers 14 together while providing sufficient flexibility to enable mat 10 to conform to contours of the ground and be able to sustain the weight of a vehicle. Preferably, connecting member 24 is a steel cable having a diameter of about ⅜ inch to about ¾ inch depending on the intended use.

Referring to FIG. 1, connecting member 24 is a cable having a first free end 26 that is connected to a coupling member 28 at one end of mat 10. Coupling member 28 can be, for example, a clamp or clasp capable of attaching to cable 26 and preventing the first end 26 of cable 24 from passing through the holes 20 in planks 12. Cable 24 extends through each of the planks 12 and spacers 14 to a second end of mat 10 where a second coupling member 30 is attached to cable 24. The length of cable 24 between coupling member 28 and coupling member 30 defines a coupling portion of cable 24. A second end 32 of cable 24 is clamped by a coupling member 34 at a first end of mat 10. A second coupling member 36 is also attached to cable 24 at an opposite end of mat 10 to define a coupling portion of cable 24. A length of cable 24 extending between coupling members 30 and 36 forms an open loop 38.

In the embodiment illustrated, two cables 24 are provided that extend through aligned holes 20 in planks 12 and holes 22 in spacers 14 from opposite ends of mat 10 to form loops 38 at each end of mat 10. In further embodiments, additional holes in planks 12 and additional spacers provided to receive additional cables can be spaced along the length of mat 10 to strengthen mat 10 as needed. The spacing of the cables and the number of cables is selected based on the length and flexibility of planks 12 and the width of spacers 14. The coupling members 34 and 36 are attached to cable 24 to provide sufficient slack to cable 24 to allow mat 10 to be folded or rolled in the longitudinal dimension of cable 24 as shown in FIGS. 2 and 3.

Mat 10 can be assembled in a length and width suitable for the appropriate intended use. For example, mat 10 can be made from planks that have a width or diameter of about 3 inches to about 8 inches and a length of about 3 feet to about 25 feet as needed. In a similar manner, the number of planks 12 and spacers 14 coupled together are not particularly limited and can vary depending on the intended use. For a typical road bed, the mat is assembled from planks to provide a mat having length of about 25 to 50 feet. Typically, the width of mat 10 is determined by the length of the planks. It will be appreciated by one skilled in the art that the length of the mat is limited only by the ability to transport the mat to a desired site.

The planks can be made from various materials depending on the intended use. In a preferred embodiment, the planks are made of a suitable plastic material such as high density polyethylene by extrusion or injection molding processes as known in the art. Generally, the holes for receiving the cable are drilled after the planks are molded. In alternative embodiments, the holes can be molded into the planks.

In use, mat 10 can be rolled on a spool or drum 40 for shipping as shown in FIG. 3 and unrolled at the work site. The mat 10 is placed on the ground with the planks 12 oriented either transversely or longitudinally with respect to the direction of the road bed. Cable 24 provides sufficient slack to permit limited movement between adjacent planks 12 and spacers 14. The slack in cable 24 enables mat 10 to conform to the ground surface and allow some bending in the longitudinal direction to allow the road bed to bend as needed.

The orientation of the mat 10 on the ground is determined by the desired shape and dimension of the road bed. A desired number of the mats are laid adjacent one another to attained the desired length and width of the road bed. In embodiments of the invention, the mats can be stacked or superimposed on one another to attained a desired thickness of the road bed.

As shown in FIG. 2, the planks 12 of superimposed mats 10 nest between adjacent planks 12 of a superimposed mat. Preferably, the planks 12 are spaced apart a distance less than the width of the planks 12 so that when stacked, the planks 12 cannot pass between each other. Mats 10 are preferably stacked in the same orientation so that planks 12 of each mat 10 are substantially parallel. In alternative embodiments, the stacked mats can be oriented perpendicular to each other. In one embodiment of the invention, the mats are placed on the ground and a filler such as sand or gravel is used to fill the spaces between the planks to stabilize the mats 10.

Figure 6:
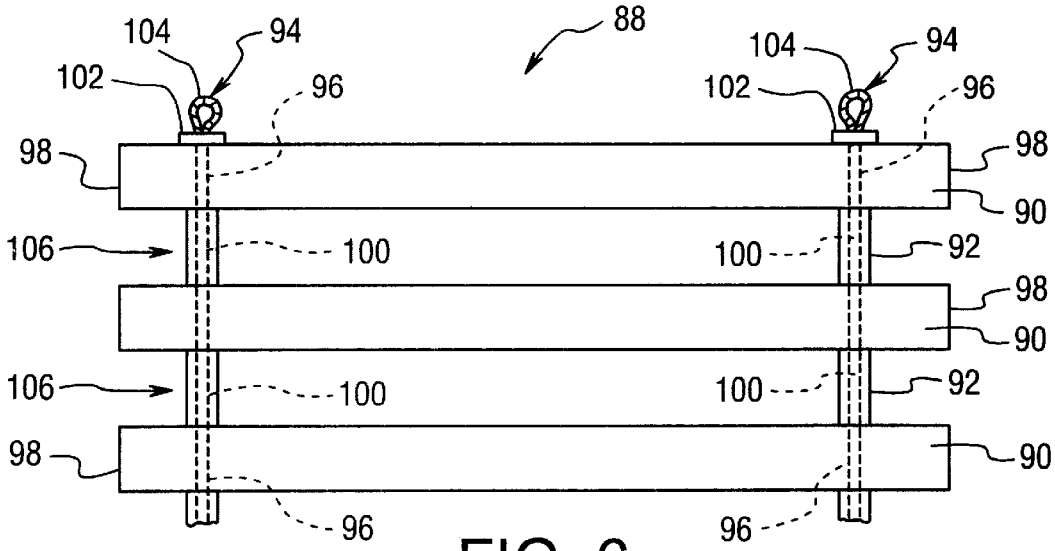
FIG. 6 is a partial top view of a mat in a third embodiment of the invention.

Referring to FIGS. 4–6, a mat 50 is constructed in a similar manner to the embodiment of FIG. 1 and includes a plurality of planks 52 and 53, spacers 54 and a cable 56 extending through transverse holes 58 in planks 52 and 53 and holes 60 in spacers 54. In the embodiment as shown, planks 52 and 53 have a substantially cylindrical shape and spacers 54 have a square cross-section as in the embodiment of FIGS. 1–3. Alternatively, planks 52 and 53 can have a square cross-section. In this embodiment, a single cable 56 passes through each of the holes 58, 60 in planks 52 and 53 and spacers 54, respectively, to form a loop 62 at one end of mat 50. The free ends of cable 56 are attached to a coupling member 64 to couple cable 56 to planks 52. A second coupling member 66 is attached to cable 56 at the opposite end of mat 50 to limit sliding movement of planks 52 and 53 on cable 56.

In the embodiment illustrated, planks 52 are provided with a coupling member 68 extending axially from at least one axial end. Planks 53 in the embodiment shown have substantially flat axial ends 55 and an overall length of planks 52. Coupling member 68 of plank 52 extends beyond axial end 55 of plank 53 to form a staggered side edge of mat 50. As shown in FIG. 5, coupling member 68 is in the form of a tab-like member having a height about one-half the height of planks 52. Coupling members 68 form a notch or recess 70 having a vertical wall 72 extending in a transverse direction with respect to the longitudinal dimension and a bottom wall 74 extending in the longitudinal plane of plank 52. Each coupling member 68 is provided with a hole 76 extending transversely through coupling member 68. Preferably, recess 70 faces in an outward direction with respect to the plane of mat 50. In a preferred embodiment, bottom wall 74 of recess 70 extends along a plane that substantially bisects plank 52 along its longitudinal axis. Preferably, recess 70 is dimensioned to receive a coupling member 68 of an adjacent mat 50.

Coupling members 68 extend axially from planks 52 for coupling two mats 50 in an end-to-end relation. As shown in FIGS. 4 and 5, coupling members 68 and recesses 70 complement each other so that coupling members 68 of adjacent mats 50 are able to overlap one another to form a lap joint with the holes 76 aligned for receiving a fastener 78. Planks 53 have a length so that axial ends 55 either abut or are closely spaced to an axial end 55 of an adjacent mat when coupling members 68 are coupled together.

In a preferred embodiment, an annular shaped sleeve 80 having an axial passage 82 encircles coupling members 68.

Sleeve 80 includes a transverse hole 84 for receiving fastener 78 and coupling the ends of planks 52 together. Fastener 78 can be a pin that is press-fitted into the hole in sleeve 80 and coupling members 68. In alternative embodiments, fastener 78 can be a screw, a nut and bolt arrangement or a shaft and cotter pin arrangement.

In the embodiment illustrated, alternating planks 52 of each mat 50 are provided with a coupling member 68, which extend beyond axial end 55 of planks 53. In further embodiments, each plank can be provided with a coupling member so that each plank can be coupled to a plank of an adjacent mat. In still further embodiments, coupling members can be provided on each plank and oriented so that the recess 70 of adjacent planks face in alternating directions. The actual number and arrangement of planks 52 with coupling members 68 joined with planks 53 form mat 50 is determined by the intended use and desired strength of mats 10.

Figure 7:
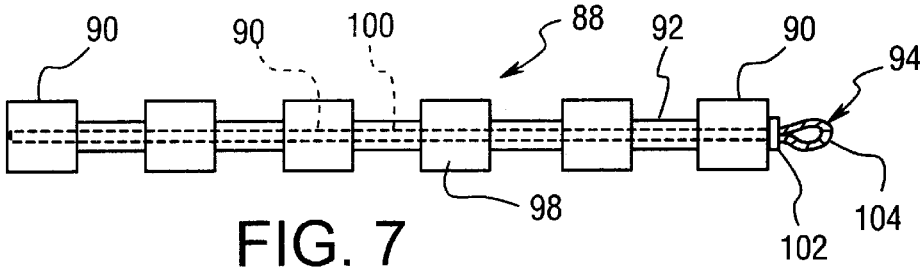
FIG. 7 is an end view of the mat of the embodiment of FIG. 6.

Referring to FIGS. 6 and 7, a mat 88 is shown including a plurality of planks 90, spacers 92 and connecting cables 94. In this embodiment, planks 90 have a substantially square cross-section as shown in FIG. 7. Each plank 90 includes a hole 96 extending transversely through the plank. In the embodiment illustrated, hole 96 is spaced from each axial end 98 of plank 90.

Spacers 92 have a substantially square cross-section and a longitudinal dimension extending between adjacent planks 90. Spacers 92 have a height and width less than a height of planks 90 and include an axial passage 100 extending in the longitudinal direction of spacer 92.

Axial passage 100 of spacer 92 is aligned with passage 96 of planks 90 and cable 94 is passed through the passages for coupling the planks and spacers together. As in the previous embodiment, a clamping member 102 is coupled to cable 94 at each end of mat 88 for retaining planks 90 and spacers 92 on cable 94. Cable 94 is formed with a loop 104 for lifting and maneuvering mat 88. In this embodiment, two cables 94 are provided adjacent each axial end 98 of planks 90. In further embodiments, additional cables can be provided to provide sufficient strength to the mat as needed.

Figure 7A:
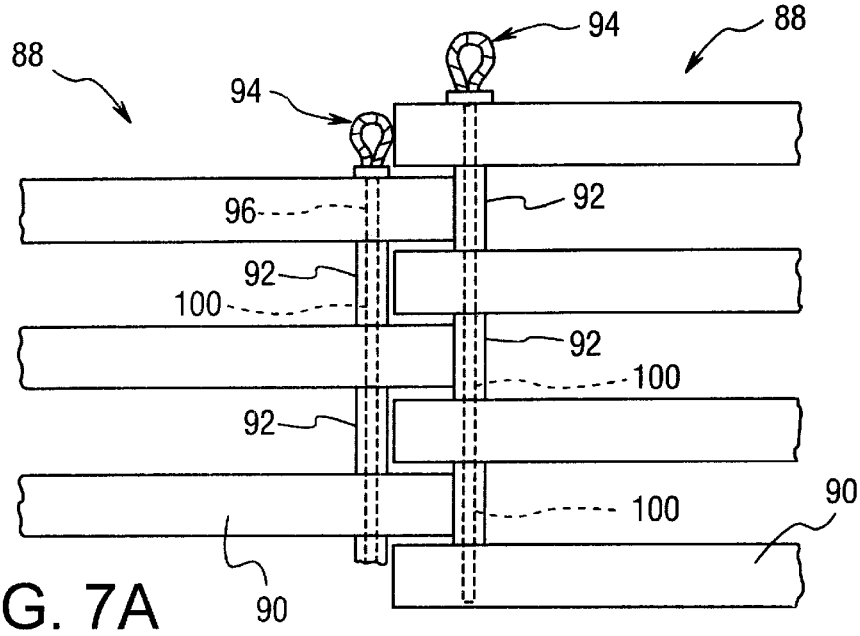
FIG. 7A is a top view of two mats of FIG. 6 coupled together end-to-end.
Figure 7B:
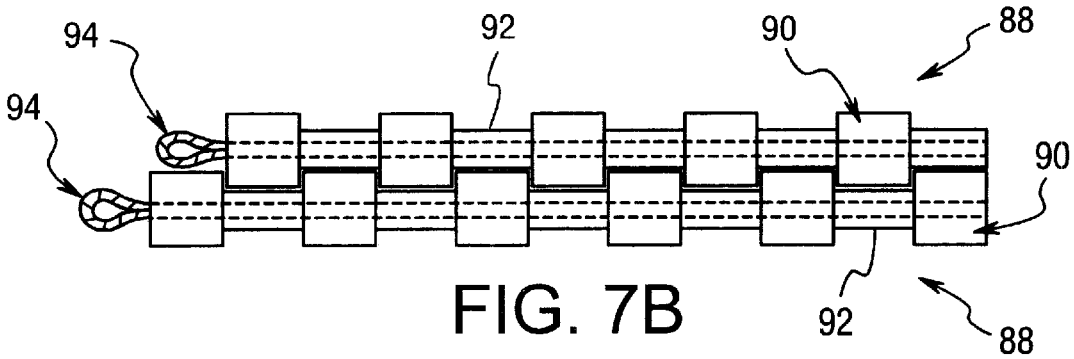
FIG. 7B is an end view of two mats of FIG. 6 coupled together in a stacked fashion.

In the embodiment of FIGS. 6 and 7, spacers 92 have a longitudinal length substantially equal to a width of planks 90. In this embodiment, spacers 92 have a longitudinal dimension oriented in a transverse direction with respect to a longitudinal dimension of planks 90. Alternating planks 90 and spacers 92 form an interlocking notch 106 between adjacent planks 90. The axial end 98 of each plank 90 forms an interlocking tab. In this manner, two identical mats can be coupled together in a end-to-end relation with the axial end 98 of each plank 90 interfitting in notch 96 of the adjacent mat as shown in FIG. 7A. In further embodiments of forming a road bed, the mats can be stacked with the planks 90 interlocked as shown in FIG. 7B. When the mats are stacked as shown in FIG. 7B, it is generally desirable to fill the spaces between the planks with sand or other filler to stabilize the bed.

Figure 8:
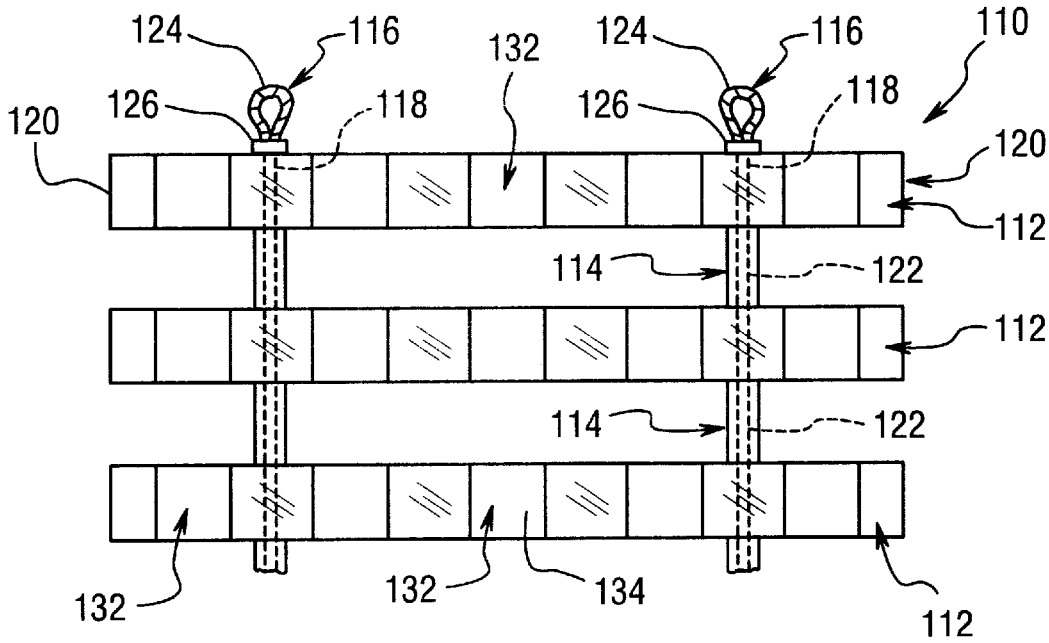
FIG. 8 is a top view of a mat in a fourth embodiment of the invention showing the interlocking recesses in the top face of the planks.
Figure 9:
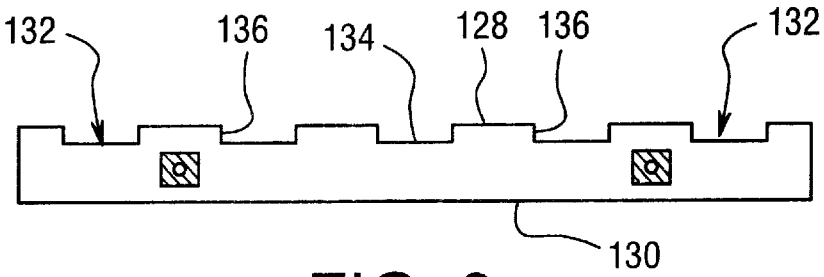
FIG. 9 is an end view of the mat of FIG. 8.

Referring to FIGS. 8–11 in a further embodiment of the invention, a road bed is formed from several mats that are stacked in an interlocking manner. As shown in FIGS. 8 and 9, a first mat 110 includes a plurality of spaced-apart planks 112, spacers 114 and connecting cables 116. As in the previous embodiment, planks 112 have a longitudinal dimension and a generally square cross-section. Each plank 112 includes a passage 118 adjacent each axial end 120 extending transversely through plank 112 to receive cables 116.

Spacers 114 have a substantially square cross-section with a longitudinal dimension extending substantially perpendicular to a longitudinal dimension of planks 112. Spacers 114 have opposite axial ends that extend between adjacent planks 112. Each spacer 114 includes an axial passage 122 extending the entire length of spacer 114. In the embodiment illustrated, spacers 114 have a height and width less than a height of planks 112.

Cables 116 extend through each of the axial passages 118 and 122 of planks 112 and spacers 114 for coupling planks and spacers together. A loop 124 and clamping member 126 are provided at the ends of cables 116 as in the previous embodiments.

Figure 10:
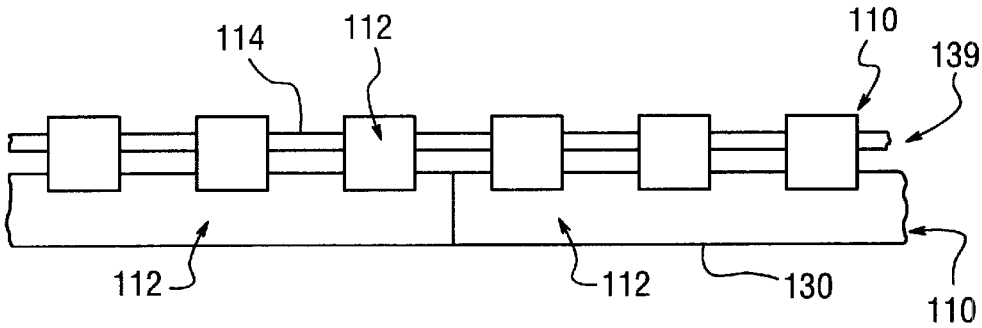
FIG. 10 is an end view of a road bed constructed from superimposed layers of the mat of the embodiment of FIG. 8.

Planks 112 have a top face 128 and a bottom face 130 that are substantially parallel to each other. In this embodiment, bottom face 130 is a flat planar surface. Top face 128 is provided with spaced-apart recesses 132. Each recess 132 has a substantially flat bottom surface 134 extending parallel to the longitudinal axis of plank 112. Recess 132 has two opposing side surfaces 136 extending substantially perpendicular to bottom surface 134. Preferably, recesses 132 have a depth sufficient to interlock with a plank of a superimposed mat. Recesses 132 are spaced-apart a distance corresponding to the longitudinal length of spacers 114 and the spacing of planks 112 of mat 110. As shown in FIGS. 9 and 10, recesses 132 in each plank 112 are aligned in rows so that mats 110 can be stacked together with planks 112 of each layer oriented substantially perpendicular to each other.

Figure 11:
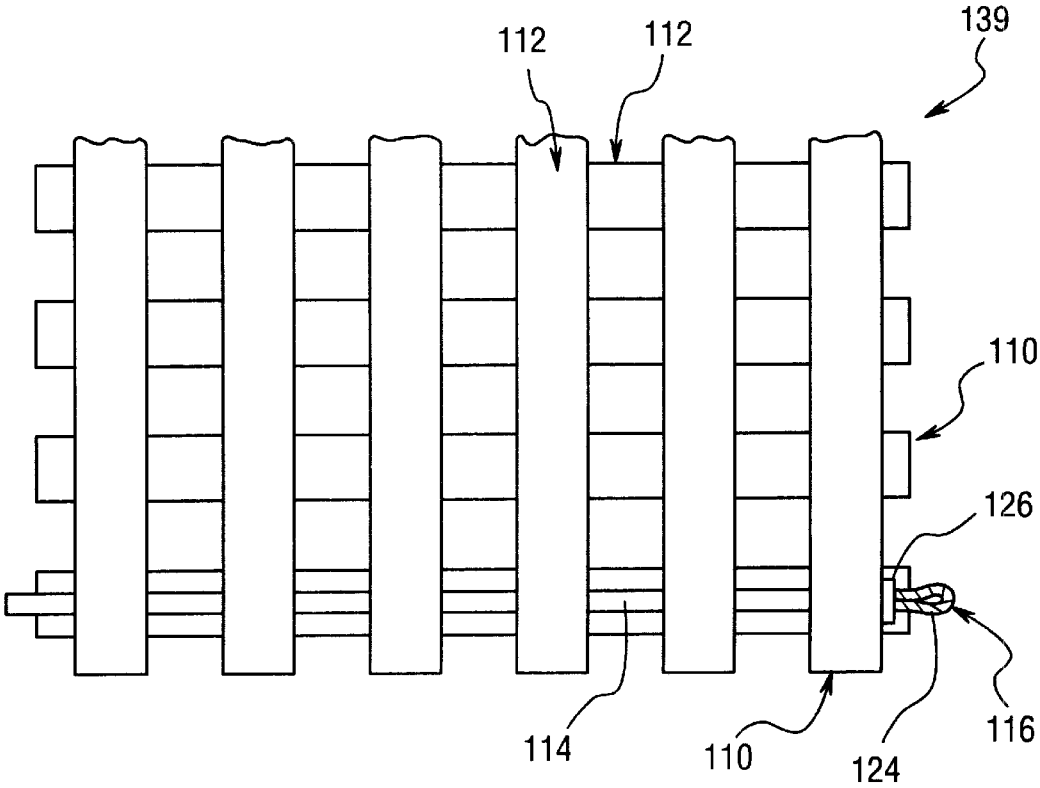
FIG. 11 is a top view of the road bed of FIG. 10.

A road bed 139 can be formed from a plurality of mats 110 by placing a first layer of mats 110 on the ground with recesses 132 facing upwardly. A second layer of mats can be placed on top of the first layer of mats with the planks 112 extending generally perpendicular to the planks of the first mat. The second mat can be positioned with the recesses facing upwardly and the bottom face 130 of planks 112 received in recesses 132 of the bottom layer of mats. In one preferred embodiment, the second layer of mats is oriented with the recesses 132 facing downwardly and positioned for interlocking with the opposing recesses 132 of the first layer of mats as shown in FIGS. 10 and 11. This orientation is generally preferable since the interlocking recesses prevent lateral movement of the mats with respect to each other.

A road bed can be formed from any number of layers of mats that can be stacked to a desired height as needed. The number of layers of mats that are stacked is primarily determined by the stability of the ground. Soft or marsh ground conditions may require several interlocked layers to form a stable road bed. As in the previous embodiment, the spaces between the planks can be filled with a suitable filler material such as sand.

Figure 12:
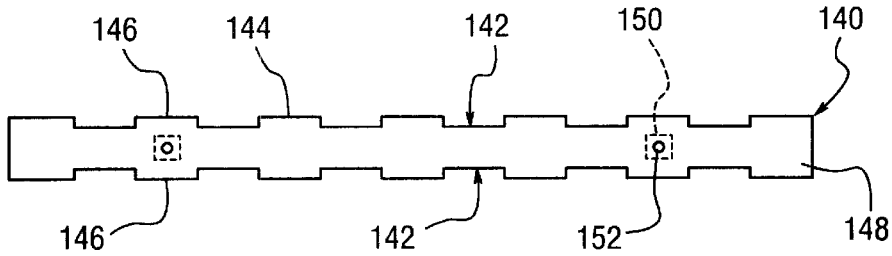
FIG. 12 is a side view of a mat formed from planks having interlocking recesses on top and bottom faces.
Figure 13:
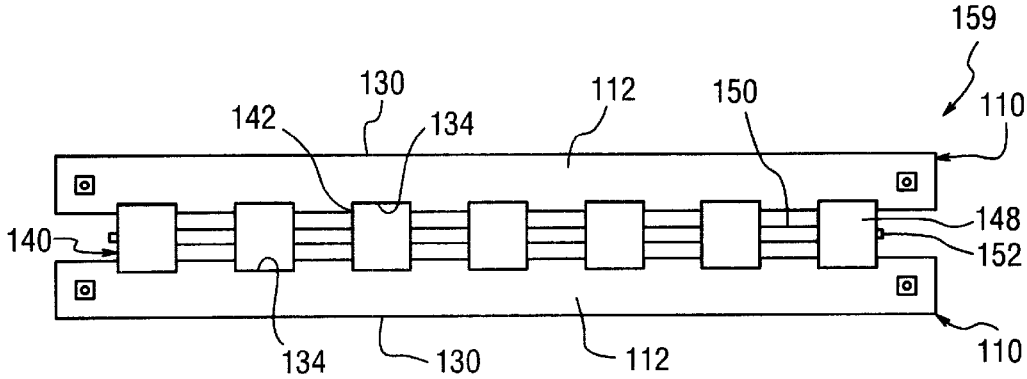
FIG. 13 is a side view of a road bed in a further embodiment of the invention.

In a further embodiment of the invention, three layers of mats are stacked to form a road bed. As shown in FIG. 12, an intermediate mat 140 is provided for interlocking with two mats 110. Mat 140 is similar to mat 110 except that recesses 142 are provided in a top face 144 and bottom face 146. As shown in FIGS. 12–13, recesses 142 in top face 144 and bottom face 146 are positioned opposite each other and spaced apart a distance substantially equal to the spacing of the planks 148. In alternative embodiments, recesses 142 in top face 144 can be staggered with respect to recesses 142 on bottom face 146. Spacers 150 and connecting cables 152 extend through axial passages 154 and 156 of planks 148 and spacers 150, respectively, for coupling planks 148 and spacers 150 together as in the previous embodiments.

Figure 14:
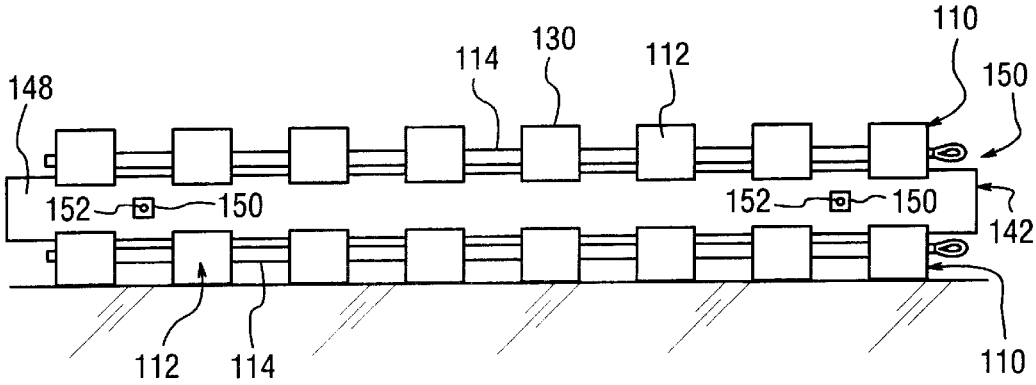
FIG. 14 is an end view of the road bed of the embodiment of FIG. 13.

As shown in FIGS. 13 and 14, a road bed 159 is formed from a mat 140 that is stacked onto a mat 110 with recesses 142 of mat 140 interlocking with recesses 142 of mat 110. A second mat 110 forming a third layer is then positioned on top of mat 140 with the respective recesses interlocking with each other. In further embodiments, several identical mats 140 can be stacked in an interlocking fashion to attain a desired height of the road bed. Preferably, a mat 110 forms the top surface of the road bed with the flat surface facing upward. In further embodiments, a mat 140 having recesses 142 facing upward can form a top layer of the road bed where recesses 142 form a gripping surface for the road bed.

In a further embodiment shown in FIGS. 15–19, a mat 160 includes a plurality of planks 162, spacers 164 and connecting cables 166. In this embodiment, planks 162 have a generally rectangular cross-section with a height greater than its width. Planks 162 have a longitudinal dimension with an axial face 168 at each end. Several spaced-apart passages 170 extend transversely through plank 162.

Each plank 162, as shown in FIG. 13, includes a top face 172 and a bottom face 174. Top face 172 includes a recess 176 opening upwardly and spaced from one axial face 168. A second recess 176 is formed in bottom face 174 opening downwardly and spaced from the opposite axial face 168. Each recess 176 has a bottom surface 178 generally parallel with top face 172 and bottom face 174 of planks 162. Each recess 176 is formed with opposite side surfaces 180 extending substantially perpendicular to bottom surface 178.

Figure 19:
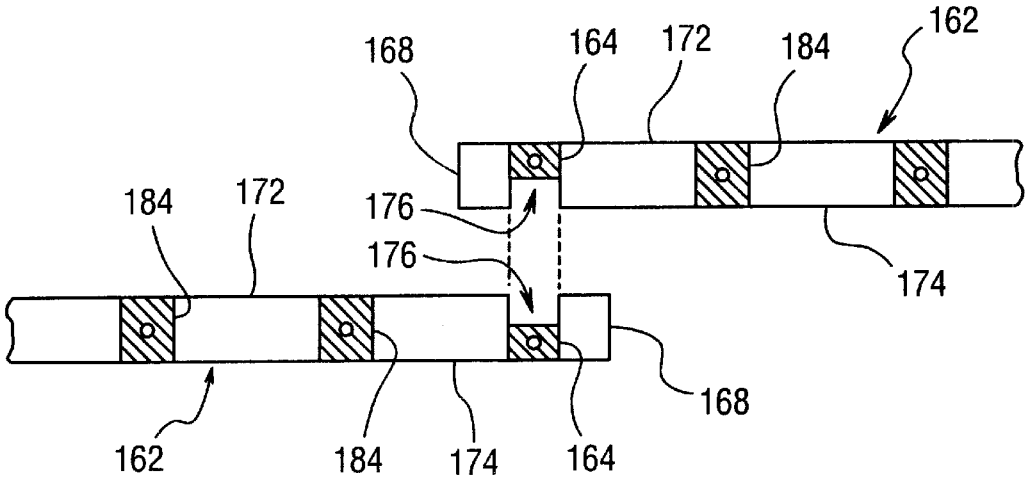
FIG. 19 is a partial cross-sectional side view showing the interlocking notches of the mat of the embodiment of FIG. 15.

End spacers 164 have a generally rectangular cross-section with a longitudinal dimension corresponding substantially to a width of planks 162, thereby spacing planks 162 apart a distance equal to the width of planks 162. End spacers 164 have a height and width corresponding substantially to the dimensions of recesses 176. As shown in FIG. 19, end spacers 164 are positioned between adjacent planks 162 adjacent recesses 176 so that a top surface 182 of end spacers 164 are aligned with bottom face 174 of the respective recess 176.

A plurality of intermediate spacers 184 are positioned between end spacers 164. Each intermediate spacer 184 has a generally square cross-section with a height substantially equal to a height of planks 162. Intermediate spacers 184 have a top face 186 substantially coplanar with top face 172 of planks 162 and a bottom face 188 substantially coplanar with bottom face 174 of planks 162. Intermediate spacers 184 have a longitudinal dimension substantially equal to the longitudinal dimension of end spacers 164 to provide a uniform spacing of planks 162. Each of the spacers 164 and 184 have a transverse passage 190 and 192 in end spacers 164 and intermediate spacers 184, respectively. Cables 166 extend through the passages for coupling planks 162 and spacers 164 and 184 together as in the previous embodiments. In the embodiment illustrated, cables 166 adjacent axial faces 168 of planks 162 are provided with a loop 194 for lifting and moving mat 160.

Figure 15:
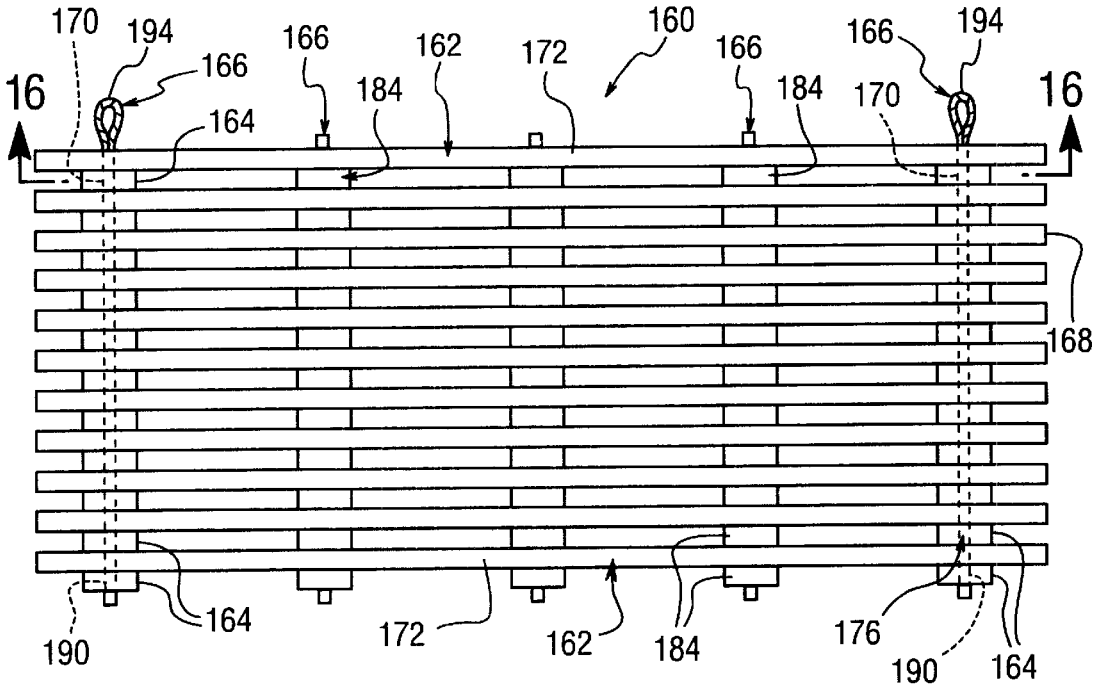
FIG. 15 is a top view of a mat in a further embodiment of the invention.
Figure 16:
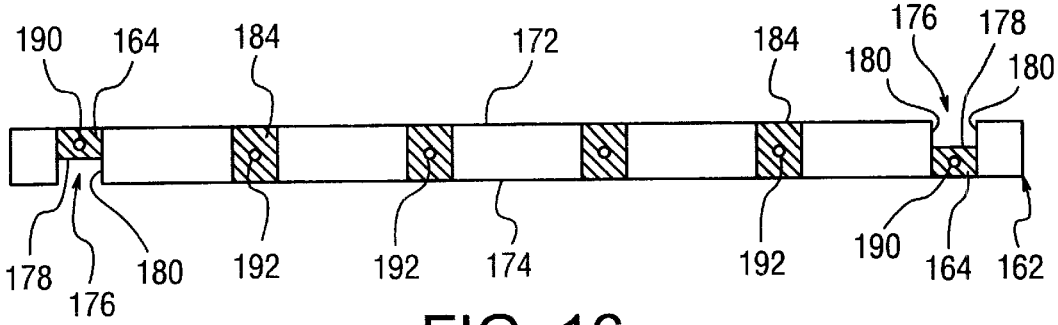
FIG. 16 is a cross-sectional view of the mat of FIG. 15.
Figure 17:
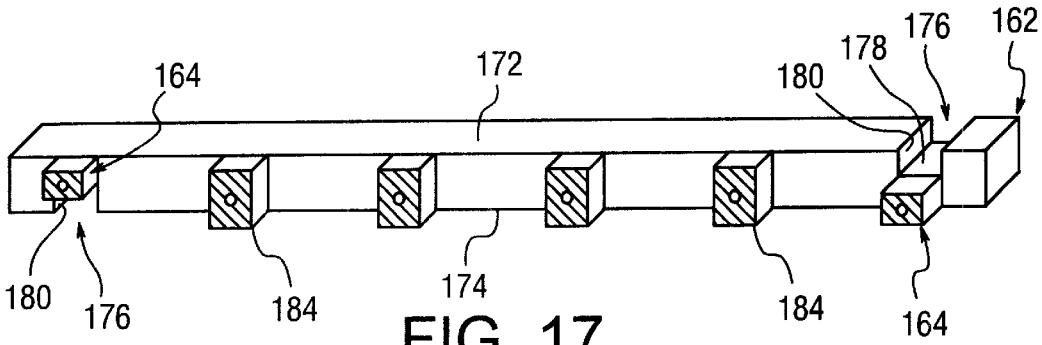
FIG. 17 is a perspective view of the mat in cross-section of FIG. 15 showing the interlocking notches for coupling with an adjacent mat.
Figure 18:
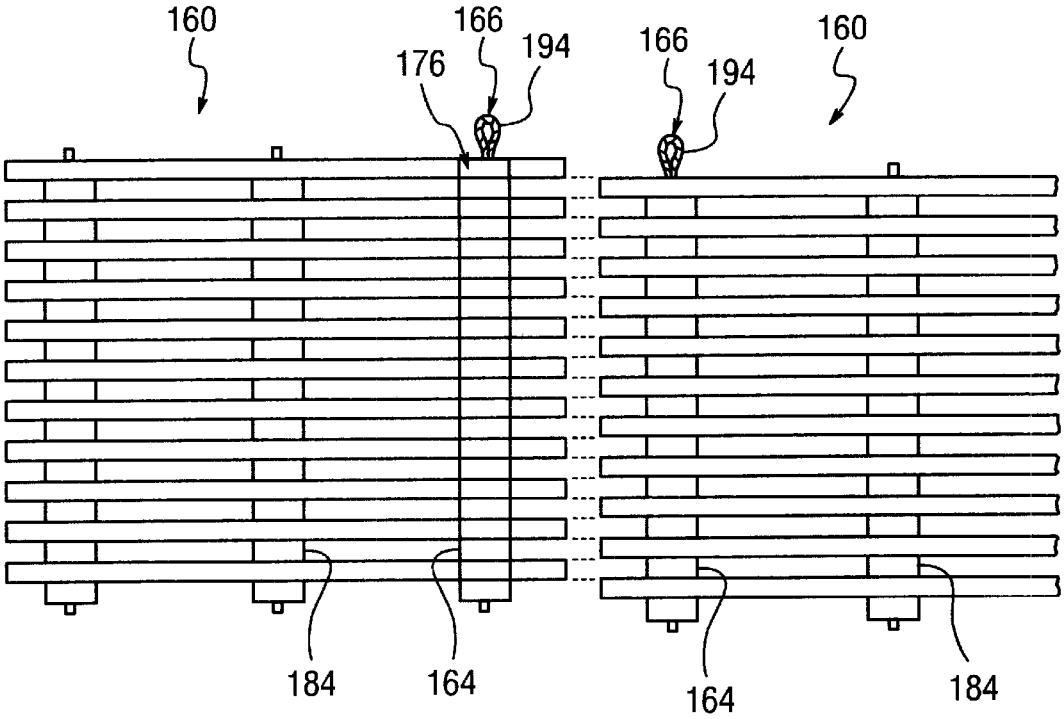
FIG. 18 is a top view of the road bed assembled from the mats of FIG. 15.

Referring to FIGS. 18 and 19, a road bed 196 is formed by coupling two identical mats 160 together. As shown in FIG. 15, the upwardly facing recess 176 and the downwardly facing recess 178 of each plank 162 are able to interlock with an end spacer 164. In this manner, the mats 160 can be interlocked together end-to-end with the top surfaces 172 of each plank 162 lying in substantially the same plane.

In each of the embodiments, the mats are formed by a plurality of planks coupled together by at least two cables or other flexible members. The cables are coupled to the planks to form a mat that is sufficiently flexible to conform to the terrain and can be rolled into a coil or rolled onto a spool. The mats have an overall length determined by the length of the cable coupling the planks together. Typically, the length of the mats is greater than the width so that the mats are unrolled in the longitudinal direction of the road bed with the planks lying transverse to the road bed. In some embodiments, it may be desirable to have the length of the mats less than the width. For example, the mats can have a length corresponding to the width of the road bed so that the planks extend in the longitudinal direction of the road bed.

While various embodiments have been chosen to illustrate the invention, it will be appreciated by one skilled in the art that various modifications can be made to the device without departing from the scope of the invention as defined in the appended claims.

What is claimed is:

1. A flexible mat having a side edge defining a longitudinal dimension and having a transverse dimension for forming a temporary road bed, said mat comprising:

a plurality of substantially cylindrical support members arranged in a parallel, side-by-side relationship and oriented in said transverse dimension of said mat, each of said support members having a length with a first axial face, a second axial face and a width, wherein said length is greater than said width, said support members further having an outer surface, at least two holes extending transversely through each of said support members and being spaced inwardly from said first axial face and said second axial face, at least one of said support members having a coupling member extending from a first axial face for coupling with a coupling member of a support member on an adjacent mat, each said coupling member having an outer surface aligned with said outer surface of said respective support member and having a coupling face oriented in a plane substantially parallel to said longitudinal dimension of said mat;

a plurality of spacers, where a respective spacer is positioned between adjacent support members for spacing said support members apart a substantially uniform distance, each said spacer having a length and a width, said length of said spacers being less than a length of said support members, and said spacers having a hole extending therethrough in a longitudinal direction; and a flexible connecting member extending through said holes in said support members and said spacers for coupling said support members and spacers together and forming said mat, wherein said mat is flexible along said longitudinal dimension to conform to a ground surface.

2. The mat of claim 1, wherein said flexible connecting member is a cable.

3. The mat of claim 2, wherein said holes in said support members are spaced from first and second longitudinal ends of said support members, said cable having a first end portion extending through said holes spaced from said first longitudinal end, a second end portion extending through said holes spaced from said second longitudinal end, and a loop portion extending between said first and second portions.

4. The mat of claim 1, wherein said flexible connecting member comprises a first cable having a first end and second end extending through said holes in said support members from a first end of said mat to a second end to form a first loop at said first end of said mat, and a second cable having a first end and second end extending through said holes in said support members from said second end of said mat to said first end to form a second loop at said second end of said mat.

5. The mat of claim 1, wherein said spacers have a length less than a width of said support members, whereby adjacent support members are spaced apart a distance less than a width of said support members.

6. The mat of claim 5, wherein said spacers have a height less than a height of said support members.

7. The mat of claim 1, wherein said support members have a cylindrical shape and said spacers have a substantially square crosssection.

8. The mat of claim 1, wherein said coupling member comprises a tab extending from said first axial face and having a height about one half a height of said support member and having a substantially planar coupling surface, and having a hole extending transversely through said tab for receiving a fastener, said hole having an axis extending in a direction substantially perpendicular to said longitudinal dimension of said mat.

9. A temporary road bed comprising a plurality of flexible mats coupled together, each of said mats having a longitudinal side and a transverse end, each of said mats comprising:

a plurality of substantially cylindrical planks arranged in a transverse direction with respect to the longitudinal side of said mat in a spaced-apart parallel relationship, said planks having at least two spaced apart holes extending transversely through said planks, each of said planks having a first axial face aligned with an adjacent plank to define said longitudinal side of said mat, and a second axial face, said holes being spaced inwardly from said first axial face and said second axial face;

a plurality of spacers between said planks for spacing said planks apart a substantially uniform distance, each of said spacers having a length, a width, and a hole extending therethrough in a longitudinal direction, wherein said length of said spacers is less than a width of said planks, whereby said planks are spaced apart a distance less than the width of said planks;

a flexible connecting member extending through said holes in said planks and said spacers for connecting said planks and spacers together, said connecting member being sufficiently flexible whereby said mat can be rolled onto a spool and can conform to the contour of the ground;

at least one of said planks of each of said mats having a coupling member extending axially from said first axial face, said coupling member having a height less than a height of said plank, a coupling surface coplanar with a longitudinal axis of said plank and a hole extending transversely through said coupling member along an axis that is transverse to a plane of said mat, wherein said temporary road bed includes at least two of said mats arranged with said planks of each respective mat positioned end to end and said coupling members of the respective planks coupled together, and said road bed further comprises a fastener extending through said holes in said coupling members for coupling said longitudinal sides of said mats together in a side-by-side relation.

10. The road bed of claim 9, wherein a plurality of said mats are laid with said longitudinal axis of each of said planks extending in a generally transverse direction to a longitudinal dimension of said road bed.

11. The road bed of claim 9, wherein a plurality of said mats are laid with said longitudinal axis of each of said planks extending in a substantially parallel direction to a longitudinal dimension of said road bed.

12. The road bed of claim 9, further comprising a substantially annular sleeve surrounding said coupling members and having a hole extending transversely through said sleeve, wherein said fastener extends through said hole in said sleeve for coupling said sleeve to said coupling members.

13. The road bed of claim 9, wherein said road bed comprises a first and a second mat in a stacked, superimposed relationship, and wherein said second mat is staggered with respect to said first mat, whereby said planks of said second mat overlie said spacers of said first mat.

14. A temporary road bed comprising a plurality of flexible mats coupled together, each of said mats having a longitudinal side and a transverse end, comprising:

a plurality of planks having substantially parallel top and bottom faces arranged in a transverse direction with respect to said mat and substantially parallel sides extending between said top and bottom faces, said planks arranged in a transverse direction with respect to said mat in a spaced-apart parallel relationship, said planks having at least two spaced apart holes extending transversely through said planks, each of said planks having a first axial face aligned with an adjacent plank to define said longitudinal side of said mat, and a second axial face, said holes being spaced inwardly from said first and second axial face;

a plurality of spacers between said planks for spacing said planks apart a substantially uniform distance, each of said spacers having a length, a width, and a hole extending therethrough in a longitudinal direction, wherein said spacers have a height substantially equal to the height of said planks;

a flexible connecting member extending through said holes in said planks and said spacers for connecting said planks and spacers together, said connecting member being sufficiently flexible whereby said mat can be rolled onto a spool and can conform to the contour of the ground;

at least one of said planks of each of said mats having a coupling member extending axially from said first axial face, said coupling member having a width less than a width of said plank, a coupling surface coplanar with a longitudinal axis of said plank and a hole extending transversely through said coupling member along an axis that is transverse to a plane of said mat, wherein said temporary road bed includes at least two of said mats arranged with said planks of each respective mat positioned end to end and said coupling members of the respective planks coupled together, and said road bed further comprises a fastener extending through said holes in said coupling members for coupling said longitudinal sides of said mats together in a side-by-side relation.

15. The road bed of claim 9, wherein said spacers have a height less than a height of said planks.

16. A method of producing a road bed comprising the steps of:

providing a plurality of flexible mats, each mat constructed of a plurality of support members arranged in a parallel, side-by-side relationship, each of said support members having a length and a width, wherein said length is greater than said width, said support members further having a first axial face, a second axial face, at least two holes extending transversely through said support members and being spaced inwardly from said first axial face and said second axial face, at least one of said support members having a coupling member extending from said first axial face thereof, said coupling member extending in a longitudinal direction with respect to said support member, said coupling member having a dimension for coupling with a coupling member of said adjacent mat, said coupling member having a height about one half a height of said support member and having a substantially planar coupling surface, and a hole extending transversely through said coupling member in a transverse direction with respect to said mat;

a plurality of spacers positioned between each of said adjacent support members for spacing said support members apart a substantially uniform distance, each said spacer having a length and a width, less than a length of said support members, and having a hole extending therethrough in a longitudinal direction; and a flexible connecting member extending through said holes in said support members and said spacers for coupling said support members and spacers together; and said method further comprising placing each of said mats on the ground to be contiguous with an adjacent mat and inserting a fastener through said hole in said coupling members to couple said adjacent mats together to form said road bed.

17. The method of claim 16, comprising orienting said mats with said support members in an end-to-end relationship with said adjacent mat to form said road bed.

18. The method of claim 16, comprising forming a first and a second layer of said mats and stacking said first and second layers of said mats to form a two-ply road bed.

19. The method of claim 16, wherein said spacers have a length less than a width of said support members, whereby a space between adjacent support members is less than a width of said support members.

20. The method of claim 14, said method further comprising positioning a substantially annular sleeve around said coupling members, said sleeves having a transverse hole, and inserting said fastener through said hole in said sleeve for coupling said sleeve to said coupling members.

21. The method of claim 16, wherein said support members have a first axial end and a second axial end, and said spacers are spaced from said axial ends of said support members and have a width substantially equal to a width of said planks, wherein said method comprises coupling said support members together in an end-to-end relationship with said axial ends of said support members interlocked together.

22. A flexible mat having a side edge defining a longitudinal dimension and having a transverse dimension for forming a temporary road bed, said mat comprising:

a plurality of support members arranged in a parallel, side-by-side relationship and oriented in said transverse dimension of said mat, each of said support members having a length with an axial face and a width, wherein said length is greater than said width, said support members further having at least two holes extending transversely through each of said support members, at least one of said support members having a coupling member on its axial face for coupling with an axial face of a support member on an adjacent mat;

wherein said coupling member includes a sleeve having an inner dimension complementing an outer dimension of said support member for coupling to said axial end of said support member of said adjacent mats;

a plurality of spacers, where a respective spacer is positioned between adjacent support members for spacing said support members apart a substantially uniform distance, each said spacer having a length and a width, said length of said spacers being less than a length of said support members, and said spacers having a hole extending therethrough in a longitudinal direction; and a flexible connecting member extending through said holes in said support members and said spacers for coupling said support members and spacers together and forming said mat, wherein said mat is flexible along said longitudinal dimension to conform to a ground surface.

23. The mat of claim 22, wherein said coupling member includes a tab extending axially from said axial face of said support member and having a width about one half a height of said support member and having a planar coupling surface for mating with a tab of an adjacent mat, and wherein said sleeve has an inner dimension to receive said tab for coupling said support member of said adjacent mats.

24. The mat of claim 8, wherein said tab extends outward from said side edge of said mat.

25. A flexible mat for forming a temporary road bed, said mat having a substantially straight longitudinal side and a transverse end, said mat comprising:

a plurality of support members arranged in a transverse direction with respect to said mat in a parallel, side-by-side relationship, each of said support members having a length, a width and an axial face, wherein said length is greater than said width, said support members further having at least two holes extending transversely through each of said support members, said support members being oriented to align said axial face of each support member to define said longitudinal side of said mat, and wherein each of said support members have a top face with a plurality of recesses having a dimension complementing said support members, said recesses being oriented and spaced apart a distance complementing a spacing of said support members and aligned in a plurality of rows for stacking a plurality of said mats;

a plurality of spacers, where a respective spacer is positioned between adjacent support members for spacing said support members apart a substantially uniform distance, each of said spacers having a length and a width, said length of said spacers being less than a length of said support members, and said spacers having a hole extending therethrough in a longitudinal direction; and a flexible connecting member extending through said holes in said support members and said spacers for coupling said support members and spacers together.

26. A temporary road bed comprising a first flexible mat having an end and a substantially straight longitudinal side, said first mat comprising:

a plurality of first support members arranged in a transverse direction with respect to said mat in a parallel, side-by-side relationship, each of said first support members having a length, a width and an axial face, wherein said length is greater than said width, said first support members further having at least two holes extending transversely through each of said first support members, said first support members being oriented to align said axial face of each support member to define said longitudinal side of said mat, and wherein each of said first support members have a top face with a plurality of first recesses having a dimension complementing said first support members, said first recesses being oriented and spaced apart a distance complementing a spacing of said first support members and aligned in a plurality of rows;

a plurality of first spacers, where a respective first spacer is positioned between adjacent first support members for spacing said first support members apart a substantially uniform distance, each of said first spacers having a length and a width, said length of said first spacers being less than a length of said first support members, and said first spacers having a hole extending therethrough in a longitudinal direction; and a first flexible connecting member extending through said holes in said first support members and said spacers for coupling said first support members and first spacers together, and a second flexible mat overlying said first mat, said second mat comprising a plurality of parallel second support members having a length and a width and having at least two holes extending transversely through each of said second support members, a plurality of second spacers positioned between adjacent second support members for spacing said second support members apart a distance complementing said spacing of said first recesses in said first support members of said first mat, and a second flexible connecting member extending through said holes in said second support members and said second spacers, wherein said second flexible mat is superimposed on said first mat with said second support members extending in a direction perpendicular to said first support members, said second support members have a bottom face received in said first recesses of said first support members and extend in a transverse direction with respect to said first support members.

27. The temporary the road bed of claim 26, wherein said second support members include a top face having a plurality of spaced-apart recesses complementing a cross-section of said second support members, said recesses being spaced apart a distance corresponding to a spacing of said second support members of said second mat for interlocking with a respective first member.

28. The temporary road bed of claim 26, wherein said second support members includes a plurality of spaced apart recesses in a top face of said second support members, said recesses being spaced-apart a distance substantially equal to a spacing of said second support members, said road bed further comprising a third mat superimposed on said second mat, said third mat having a plurality of third support members extending in a direction perpendicular to said second support members and said spaced apart recesses in said top face of said second support members of said second mat interlocking with a respective third support member.

29. The temporary road bed of claim 28, wherein said second support members are coupled together by a flexible connecting member.

* * * * *